United States Patent [19]

Spangler

[11] Patent Number: 4,915,221

[45] Date of Patent: Apr. 10, 1990

[54] CARRIER WITH ROTARY DISPENSER FOR GOLF CLUBS

[76] Inventor: Stacy F. Spangler, 15 Spring Lake Estates, Quincy, Ill. 62301

[21] Appl. No.: 398,963

[22] Filed: Aug. 28, 1989

[51] Int. Cl.[4] ..... A63B 55/00

[52] U.S. Cl. ..... 206/315.6; 206/315.3; 206/315.4; 206/315.5

[58] Field of Search ..... 206/315.2–315.8; 211/70.2; 280/DIG. 5, DIG. 6

[56] References Cited

U.S. PATENT DOCUMENTS

| | | | |
|---|---|---|---|
| 2,806,711 | 9/1957 | Jacobs | 206/315.6 X |
| 2,890,061 | 6/1959 | Watson | 206/315.6 X |
| 2,911,228 | 11/1959 | Green | 280/DIG. 6 X |
| 3,353,838 | 11/1967 | Schmid | 280/DIG. 6 X |
| 3,425,708 | 2/1969 | Sato | 206/315.6 X |
| 4,111,248 | 9/1978 | Letchhardt | 206/315.6 |
| 4,245,684 | 1/1981 | Street | 206/315.6 X |
| 4,673,082 | 6/1987 | Hemme | 206/315.6 |
| 4,709,814 | 12/1987 | Antonious | 206/315.6 X |
| 4,750,617 | 6/1988 | Anderson et al. | 206/315.6 |
| 4,753,446 | 6/1988 | Mills | 206/315.6 X |

*Primary Examiner*—Sue A. Weaver

*Attorney, Agent, or Firm*—Joseph W. Holloway

[57] ABSTRACT

A rotary dispenser for a gold club carrier wherein the dispenser includes elongated, tubular receptacles for the depending handles of each club. The carrier enclosure has an elongated lateral opening for inserting and extracting one selected club at a time. The receptacles open and extend upwardly from the rotary base of the dispenser and the are mounted on the base to be tiltable radially outwardly through the lateral opening in the carrier enclosure as each receptacle is rotated into angular alignment with the opening. Pads of gripping material are provided on the dispenser and the receptacles to restrain the receptacles from tilting; and, interferrence between the wall of the lateral opening and a receptacle serves to limit the maximum degree of receptacle tilting.

16 Claims, 2 Drawing Sheets

CARRIER WITH ROTARY DISPENSER FOR GOLF CLUBS

BACKGROUND OF THE INVENTION

This invention relates generally to a device for carrying and dispensing golf clubs. According to this invention, a carrier provides a closed cylindrical container for the clubs and has a hinged side door through which a selectable one of several clubs inside the container may be withdrawn and replaced with ease. A rotary dispenser frame is coaxially mounted within the totally enclosed container and has tubular receptacles for receiving and supporting the depending ends of the club handles. During the course of play, a golfer may obtain a desired club from the container by rotating the frame until the selected club comes into angular alignment with the side door, then opening the door and withdrawing the club. Upon completion of the shot, the club is inserted back through the door in a handle-down attitude into its assigned receptacle on the dispenser and the door is closed.

The several advantages afforded by a rotary club dispenser device over conventional club bags and club carts are well known and are adequately recited in prior U.S. Pat. Nos. 2,806,711 to Jacobs, 2,890,061 Watson, 3,425,708 Sato, 4,111,248 Leichhardt, 4,245,684 Street and 4,673,082 Hemme, among others.

Jacobs, Watson and Sato disclose wheeled golf carts having a variety of rotary club dispensing structures which support the clubs in a head-down position whereby the heads rest in tiered receptacles or the like. Over time, removal and insertion of the club heads relative to these prior art receptacles is likely to damage or degrade the club heads due to wear and repeated impacting.

Leichhardt, Street and Hemme have rotary club dispensing structures which allow the individual clubs to rest on the extreme end surfaces of the handles in a heads-up position This club orientation is preferred since it should reduce the opportunity for denting, scratching or otherwise abrading highly finished club heads. However, Street fails to recognize the advantage of providing a lateral opening to his dispenser and resorts instead to awkward vertical removal and replacement of the clubs relative to the top end of his carrier. The extra lifting effort and the opportunities for club damage due to this operational shortcoming of Street are obvious Of the several cited prior art devices, only Watson and Street show a fully enclosed club container; however, as indicated above, Watson utilizes a head-down club orientation, and Street fails to recognize the several benefits of a lateral opening for club removal and replacement.

While Liechhardt and Hemme utilize the preferred heads-up club orientation, neither recognizes the advantages afforded by housing the clubs within a closed container to protect the clubs from environmental damage on the course and from tampering or theft while in storage. Moreover, the Liechhardt and Hemme structures create certain difficulties for the golfer in replacing clubs. Liechhardt requires that a club be held handle down above the bottom of his rotary dispenser frame in precise alignment with a socket and then be inserted vertically downwardly through the socket. Moreover, the socket is shaped and sized with respect to the club handle to closely confine the handle. Therefore, unless the golfer uses great care in inserting the club and possesses visual and manual adroitness, there exists a substantial risk that the extreme end of the club will be dented, cut or otherwise damaged and that the material comprising the grip portion of the handle will suffer abrasion and rapid wear.

Hemme shows a plurality of handle-receiving cups located inside his container at the bottom of a rotary dispenser frame. The diameter of the cups is only slightly greater than that of the club handles received therein; and, the cylindrical walls of the cups extend vertically to a point only slightly above the bottom of the dispenser frame. Because the cups are small and are remotely located inside his container, Hemme finds it necessary to provide vertically extending, channel shaped guides attached to each of the cups to enable the golfer to insert the club handles into the cups. With the club head gripped by the golfer, it would not be an easy task to insert the remote end of the club handle accurately through the slot in Hemme's side wall into sliding engagement with the elongated half-cylindrical guides which are shown to be only about the same diameter as the club handle. Hemme's handle guiding channels add to the inefficiency, complexity, cost and weight of his club carrier. Moreover, the sliding contact envisioned by Hemme between the channels and the club handles can be expected to produce greatly increased wearing in the grip area of the clubs.

From the foregoing description of related prior art devices, it will be appreciated that none provides for a completely enclosed club container with a rotary dispenser having satisfactory receptacles means for efficiently receiving a club handle inserted laterally through an opening in the side of the container.

SUMMARY OF THE INVENTION

The principal object of this invention is to overcome the structural shortcomings and operational inefficiencies of prior art club carriers having rotary club dispensers.

A general object of this invention is to provide an improved rotary club dispenser which carries receptacles for the depending handle portion of each club. To this end, the receptacles open and extend upwardly from the base of the dispenser and are mounted on the base in such a manner that the receptacles may tilt or pivot radially outwardly about their lower ends. Individual receptacles may, therefore, be tilted outwardly toward and through a lateral opening in the carrier enclosure as each receptacle is rotated into angular alignment with the opening. In this tilted position, the distal end i.e. the top of the receptacle is clearly visable and accessable since the receptacle will then project upwardly and outwardly through the opening toward a golfer standing opposite the opening. With the receptacle tilted through the opening, the golfer may lift the club handle cleanly out of the receptacle without interference with any part of the carrier. After making a shot, the golfer may easily identify the top opening of the tilted receptacle and will have little difficulty in aligning the end of the club handle with this opening for full insertion of the handle into the receptacle.

Another object of this invention is to eliminate the need for any special means for guiding a club handle into a receiving receptacle on the rotary dispenser. To this end the receptacles have been made outwardly tiltable as described above and are much longer and larger in diameter than the cups shown in Hemme, for example. Preferrably, a tubular receptacle of this type is both deep enough to receive the entire grip portion of the club handle and long enough to project outwardly through the lateral opening in the carrier when tilted about its point of pivotal attachment to the dispenser bottom.

Yet another object is to provide a rotary club dispenser frame wherein the several receptacles mounted thereon are pivotable about their respective ends and have simple but effective means for releasably holding each of the receptacles in an upright position until it is desired to pivot such receptacle to the tilted position described above for club extraction.

Still another object is to provide a club carrier having a vertically extending opening in its otherwise closed cylindrical wall whereby the bottom marginal edge of such opening interferes with the pivoting receptacles described above to limit tilting movement therefore the extent of receptacle projection outwardly through such opening.

These and other advantageous features of this invention will become apparent and the invention will be best understood and fully appreciated by having reference to the following detailed description of an embodiment of the invention taken in conjunction with the accompanying drawings.

DETAILED DESCRIPTION OF THE INVENTION

Figure 1:
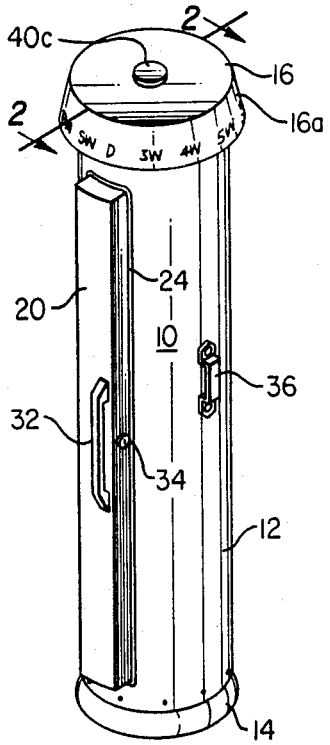
FIG. 1 is a perspective view of a golf club carrier incorporating the inventive rotary dispenser described herein.

FIG. 1 of the drawings depicts a golf club carrier, indicated generally by numeral 10, comprising an upstanding cylindrical wall 12 closed at its bottom by base 14 and overlain at its top by head 16. The wall, base and head may all be molded of a suitable high impact plastic material exhibiting light weight and durability. The base 14 is attached to the overlying lower end of the cylinder wall 12 by any well-known type of circumferentially spaced fasteners 18. The head 16 is rotatable with respect to the upper end of the cylinder 12 in a manner and for a purpose to be described hereinafter.

Figure 2:
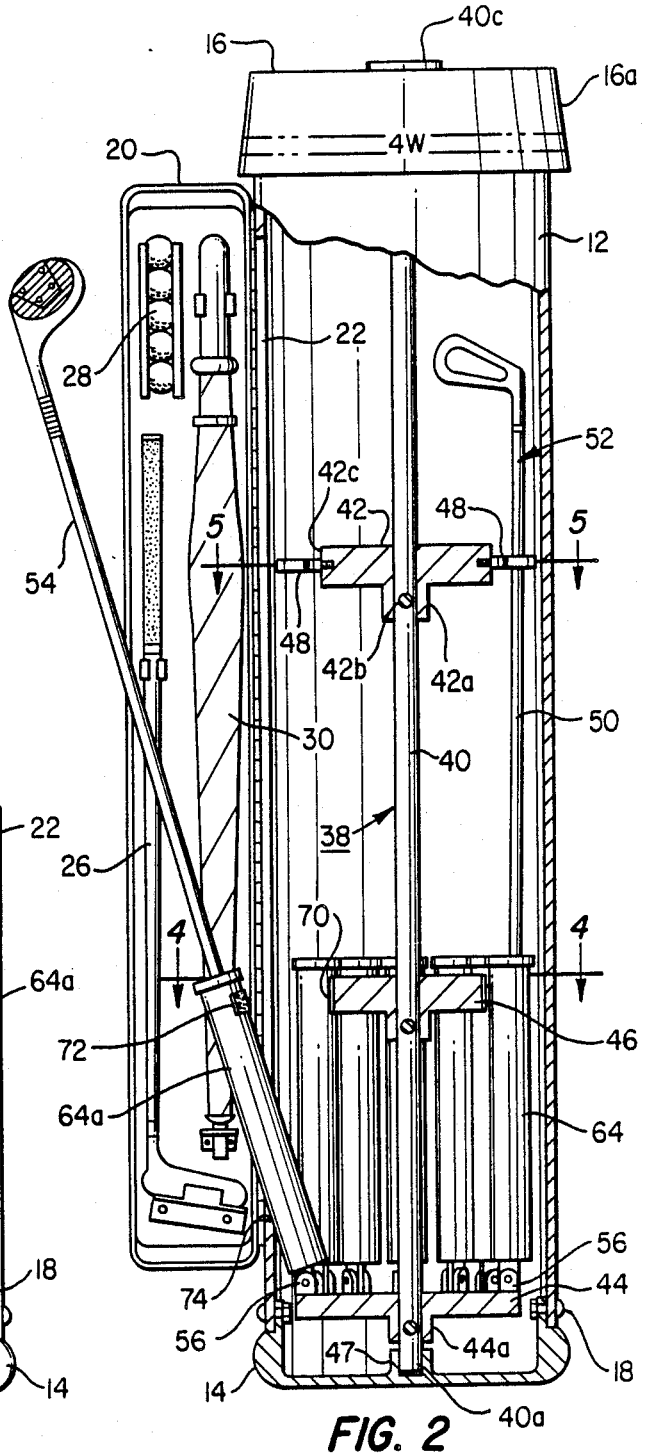
FIG. 2 is a fragmentary sectional view taken generally along lines 2—2 of FIG. 1 showing the door closure in its open position with a club and its associated receptacle tilted outwardly through the door opening.
Figure 4:
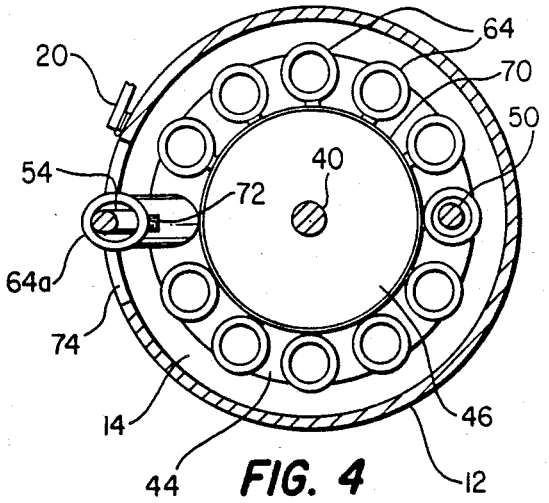
FIG. 4 is a transverse section taken generally along lines 4—4 of FIG. 2 wherein no clubs are shown and a fragment only of the door closure is shown.

As best seen in FIGS. 1 and 2, the carrier is provided with a door 20 which is swingably hinged to the wall 12. The door serves as a closure for a vertically elongated opening 22 through the wall 12; and, the door may be molded to conform to the curvature of wall 12 and may include a peripheral seal 24.

The substantial depth of the receptacle-like door enables it to house a putter 26, golf balls 28 and an umbrella 30. The door 20 may be provided with a handle 32 and a lockable latch 34.

Two brackets, one of which is indicated in FIG. 1 at numeral 36, are mounted near the longitudinal midpoint of the cylindrical wall 12 in diametric opposition to one another. The base 14 is rigid and has an enlarged, flat bottom wall to better adapt the carrier 10 for upright mounting on a horizontal shelf usually provided on motorized golf carts. The brackets 36 function to receive a suitable strap, not shown, which removably secures the carrier to an available structural member of the motorized cart. The strap is received through the brackets in such a fashion that the door 20 may be operated without interfering with the strap.

Figure 6:
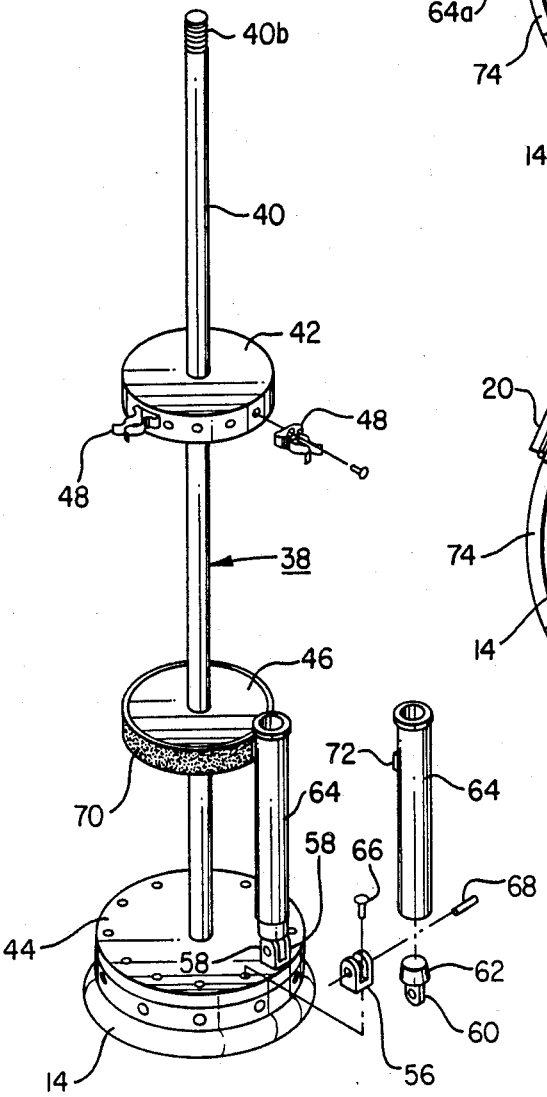

An important feature of this invention is the improved club dispenser frame which is denoted in its entirely at numeral 38 and is best illustrated in FIGS. 2 and 6. The dispenser frame includes an axle shaft 40 which coaxially penetrates and supports three vertically spaced disks, namely, an upper clip disk 42, a bottom tube mounting disk 44, and an intermediate gripping disk 46. The bottom end 40*a* of the shaft 40 is journalled in a upwardly opening socket 47 provided by base 14. The threaded upper end 40*b* of the shaft penetrates a central aperture in a transverse circular plate, not shown, which is affixed to and closes the upper end of the cylindrical wall 12. The head member 16 is nonrotatably fixed to the upper end of shaft 40 by a fastener disk 40*c* which coacts with the threaded shaft end 40*b* in a well-known manner. It will be understood that the shaft 40, the disks 42, 44 and 46, and the head 16 are rotatable with respect to the wall 12 and the base 14 about an axis of rotation which coincides with the longitudinal axis of the carrier 10.

Figure 5:
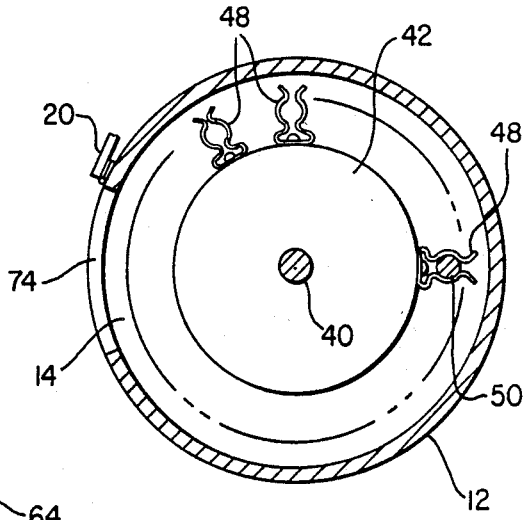
FIG. 5 is a transverse section taken generally along lines 5—5 of FIG. 2 wherein the deletion of identical clip parts is denoted by phantom lines; and, FIG. 6, is a partially exploded isometric view of certain elements of the rotary dispenser frame shown in FIG. 2.

As best seen in FIGS. 2 and 5, the shaft or axle 40 centrally penetrates the upper disk 42 and its integral boss 42*a*. A cross pin 42*b* penetrates boss 42*a* and shaft 40 to prevent rotational or axial displacement of the disk 42 with respect to shaft 40. The circumferential wall 42*c* carries angularly spaced, radially extending clips 48 of the type which are commonly used to releasably and resiliently grip elongated cylindrical members such as the shaft 50 of the illustrated golf club 52. The number of clips 48 carried by the disk 42 corresponds to the number of clubs to be stored on the rotary dispenser frame 38. Although the number of clubs normally housed in carrier 10 may be 12 or more, only one iron 52 and one wood 54 are illustrated in order to show clearly the details of the dispenser 38. The configuration and material of the clips and the illustrated means for attaching them to the disk 42 may be varied substantially from that shown in FIGS. 5 and 6 so long as the shaft portions of the several clubs in the carrier 10 are normally held firmly inwardly to disk 42, but are readily released from the clips with minimal effort on the part of the golfer.

As best shown in FIG. 2, the central shaft 40 coaxially penetrates the lower disk 44 and an integral boss 44*a* formed thereon. The disk 44 is secured to shaft 40 in the same manner and by means corresponding to pin 42*b* heretofore described with regard to disk 42. FIG. 6 best shows that extending from the upper surface of disk 44 are U-shaped brackets 56 having pairs of clevis arms 58 adapted to receive therebetween apertured tangs 60 depending from the bottom closures 62 for the elongated tubes 64. The brackets 56 are angularly spaced at equal intervals proximate the perimetric edge of disk 44 and vertically underlie the aforedescribed clips 48 extending from disk 42. The brackets 56, most of which are omitted for the sake of clarity, are fastened to disk 44 by rivets 66 or other suitable fastener means. Tangs 60 pivot about clevis pins 68 transversly penetrating the aligned apertures in clevis arms 58. The tube closures 62 may be tapered slightly for a force fit into the bottoms of the cylindrical tubes 64 or the closures may be cemented in place, as desired. It will be understood that the number of tubes 64 mounted on disk 44 in the manner described will correspond to the number of clips 48 carried by disk 42.

Figure 3:
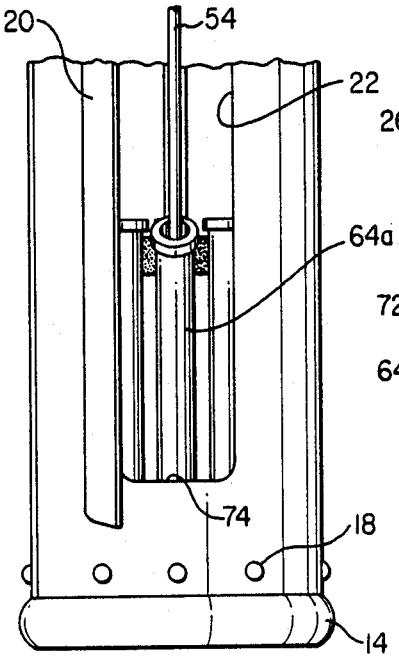
FIG. 3 is a fragmentary elevational view of the lower portion of the club carrier shown in FIG. 2.

An important feature of this invention is the provision of multiple tubes 64 which serve as receptacles for the handles of the clubs disposed inside the carrier 10. These elongated, cylindrical tubular members may be fabricated of plastic material or of lightweight metal, as preferred. If desired, the closures 62 and tangs 60 may be formed integrally with the tubes. The length of the tubes should be substantially greater than the tube diameter and may be made to accommodate the entire grip portion of the clubs. As shown in FIGS. 2 and 3, the diameter of the opening at the upper end of a tube is substantially greater than that of a club handle.

Spaced upwardly from disk 44, but below the extreme upper ends of the tubes 64, is the intermediate disk 46. This disk is coaxially penetrated by shaft 40 and is secured to shaft 40 in the same fashion as are disks 42 and 44. The disk 46 is smaller in diameter than disk 44 whereby the tubes 64 may project upwardly from disk 44 between the disk 46 and the adjacent wall 12 with sufficient radial clearance to avoid contact between the tubes and the wall when the dispenser 38 is rotated. To the outer cylindrical wall of disk 46 a ring of loose pile gripping material 70 is attached by cementing or the like. A pad 72 of the same gripping material is attached adjacent the upper end of each tube 64 with the pads 72 facing radially inwardly toward the ring 70. In a well understood manner, the interlocking action of the ring 70 and pads 72 releasably secures the tubes 64 to disk 46 in a generally vertical position when the clubs are stored interiorly of the container 10. However, the gripping action of the coacting ring and pads may be easily overcome in order to tilt or pivot a selected tubular receptacle and the club contained therein radially outwardly from the disk 46. FIGS. 2 and 3 illustrate a receptacle **64*a* containing the wood 54 in a pivoted or tilted condition wherein the pad 72 has been separated from ring 70 and the upper portion of the tube 64*a* and the club project upwardly and outwardly through the elongated opening 22 in wall 12. Radial pivoting of the tube 64*a*, as well as the club 54 disposed therein, with respect to the lower disk 44 is restrained as shown in FIG. 2, by the interference between the side of tube 64*a* and a horizontal threshhold 74 defined by the lower marginal wall of the opening 22. If it is desired to increase the degree of slope of the tubes from vertical, the vertical dimension of opening 22 may be increased during fabrication of the wall 12 or the threshhold surface 74 may be relieved somewhat in the area where it is contacted by the tubes 64**.

The head 16, although non-rotatably secured to the threaded end **40*b* of the shaft 40, is freely rotatable with respect to the upper end of the cylindrical wall 12 and serves as the means for manually rotating the dispenser frame 38 about its vertical axis. By such rotation, any of the tubes 64 and the clubs they contain may be placed in angular registration with opening 22 for removal of a club from the interior of the carrier. Indicia inscribed on the surface of peripheral wall 16*a* of the head indicate to the golfer which club is stored in a tube angularly aligned with such indicia. The indicia visible in FIG. 1 which extend from left to right about head 16** are PW, SW, D 3W, 4W, 5W and 3 indicating, respectively, pitching wedge, sand wedge, driver, three wood, four wood, five wood and three iron.

OPERATION OF THE INVENTION

Having disclosed in detail the structure of the preferable embodiment of the invention, the operation of the golf club dispenser will now be described.

Prior to beginning play, the golf clubs are loaded into the tubes in correlation with the indicia on head 16 by opening door 20, tilting out each tube 64 sequentially, inserting the proper club in each tube, and securing the club shaft in a resilient clip 48. Since the carrier according to this invention is intended to be transported by a motorized cart which carries the golfer about the golf course, the carrier 10 is mounted on the cart in a vertically upright position and is secured to the cart by a strap reeved through the brackets 36. When properly mounted on a typically constructed cart, the top of the carrier 10 is approximately head high and the door is fully accessible.

To obtain a selected club from the carrier interior, the golfer first rotates or dials the head 16 to align angularly the correct club indicium with the door 20. Any one of several brake or detent devices, which are not part of this invention and which are adequately disclosed in Watson and Leichhardt, for example, may be utilized in connection with head 16 to temporarily maintain the selected angular position of dispenser 38. When the golfer rotates the head 6, he will necessarily cause the entire dispenser frame 38 to rotate about its vertical axis whereby the receptacles 64 and clubs carried on disk 44 will rotate until the indicated club is brought into alignment with the opening 22 and is adjacent the closure door 20. To extract the selected club from the carrier, the golfer swings open door 20 about its hinged side to expose the selected club and then grasps the club about its shaft or head. A slight pull on the club directly outwardly through the opening 20 will extract the club shaft from a clip 48 and will cause the receptacle holding that club to disengage from the gripper disk 46 and pivot angularly outwardly about its pivot pin 68 and through the door opening 20 until the receptacle 64 contacts the door opening threshhold 74. FIG. 2 of the drawing depicts the position of the selected club and its receptacle at this point in the operation of the invention. The golfer then removes the club from the receptacle 64 by lifting the same until it clears the top of the receptacle. As described above, the extraction of the club from the carrier is accomplished with a degree of physical movement and effort which does not greatly exceed that required to accept a club handed to the golfer by a caddy.

While the golfer is executing a shot, the door remains open and the tube 64 from which the selected club was extracted remains in the tilted position shown in FIG. 2. Since the center of gravity of the elongated tube is outside the perimeter of the wall 12, the tube will remain, tilted against the threshhold 74 until it is positively tilted inwardly through the opening 22.

To return the club to the carrier, the golfer orients the club in a generally handle-down attitude and directs the end of the handle into the opening at the upper end of the outwardly tilted tube 64. This operation is facilitated by the present invention in three important respects:

1. The diameter of the tube opening is considerably larger than that of the club handle.
2. The targeted tube opening projects well outside the container interior and is located substantially above the bottom of the container.
3. The tube in its club-receiving attitude is tilted generally toward the golfer's head as he stands alongside the carrier.

After insertion of the club into the tilted receptacle, the club is urged inwardly through the opening 20 until the receptacle in which the club rests contacts the gripper disk 46 and the club shaft is grasped by a clip 48, in a manner of club shaft 50 shown in FIG. 2. The door 20 is then closed whereby the clubs and equipment stored in the carrier 10 are protected from dust, rain or other adverse environmental conditions encountered on the course.

If, after a club is extracted from the carrier, it is desired to close the door 20, or in the instance that one or more receptacles are not loaded with a club, the gripper ring 70 and the pads 72 will secure the empty tubes 64 in an upright position thereby restraining the same from unwanted pivoting movement and from interference with rotation of the dispenser frame 38. Thus it will be appreciated that the receptacle gripping feature of this invention not only cooperates with the clips 48 and tubes 64 in securing the clubs to the dispenser, but also advantageously serves the independent receptacle-securing function just described.

It will be apparent to those skilled in the art that modifications may be made in this invention without departing from its scope and spirit. While the invention has been shown and described in terms of particular parts and arrangements, the invention is not limited thereto except as they are specifically set forth in the appended claims.

What I claim as my invention is:

1. An enclosed container for golf clubs;
a club dispenser disposed interiorly of said container;
said dispenser comprising a frame and means for rotatably mounting the same within said container;
multiple elongated cylinders carried by said frame;
said cylinders being open at one end for receiving the handles of said clubs; and
the other end of said cylinders including means for pivotal attachment to said frame.

2. The invention according to claim 1, together with:
holding means associated with said frame and with each of said cylinders for cooperably restraining said cylinders against pivoting.

3. The invention according to claim 1, wherein:
said container has an opening through which clubs are removable and replaceable; and,
said cylinders are individually pivotable to project through said opening.

4. The invention according to claim 3, wherein:
the pivotal movement of a cylinder projecting through said opening is limited by interfering engagement between said cylinder and the marginal edge of said opening.

5. A golf club dispensing device disposed interiorly of a carrier, the latter having upright wall means with a lateral opening therethrough for removing and replacing clubs relative to said device, and said device including:
frame means rotatable relative to said wall means;
plural elongated receptacles for receiving handle portions of said clubs, and;
mounting means between said receptacles and said frame means providing tilting movement for said receptacles relative to said frame means.

6. The device defined in claim 5, wherein:
any given receptacle is extendable through said opening when said frame means is rotated to position said given receptacle adjacent said opening.

7. The device defined in claim 6, wherein:
said receptacles comprise elongated cylindrical tubes having sufficient length to receive at least a substantial segment of the handle portions; and, said cylindrical tubes have a diameter substantially greater than said handle portions.

8. The device defined in claim 5, wherein:
said frame means and said receptacles are provided with coacting releasable securing means for restraining tilting of said receptacles.

9. The device defined in claim 5, wherein said frame means includes:
an elongated shaft having an axis of rotation coincident with the longitudinal axis of said upright wall means;
a first disk fixed to said shaft; and,
said first disk carrying said mounting means for said receptacles.

10. The device defined in claim 9, wherein:
said receptacles have a closed end with a tang extending therefrom;
said mounting means comprises plural clevis brackets angularly spaced proximate the perimetric edge of said first disk;
and said tangs are, pivotably retained between arms of said clevis brackets.

11. The device defined in claim 9, together with:
a second disk fixed to said shaft in vertically spaced relation with said first disk; and,
releasable securing means for restraining tilting of said receptacles including coacting first and second gripping means respectively attached to said second disk and said receptacles.

12. The device defined in claim 11, wherein:
said first gripping means comprises loose pile gripping material attached to the circumferential wall of said second disk; and,
said second gripping means comprises pads of the same gripping material attached proximate the distal ends of said receptacles.

13. The device defined in claim 11, together with:
a third disk fixed to said shaft in vertically spaced relation with said first and second disks; and,
resilient clip means extending radially from said third disk for receiving and releasably retaining the shaft portions of clubs having handles dispose in said receptacles.

14. The device defined in claim 9, wherein:
said shaft axially penetrates said carrier and extends therebeyond; and,
the extending shaft portion has means fixed thereto for manually rotating said frame means within said upright wall means to provide angular registration of any selected one of said receptacles with said lateral opening.

15. The device defined in claim 6, wherein:

said given receptacle is limited in its tilting and extension through said opening by interfering engagement with a portion of said wall means which defines the margin of said opening.

16. The device defined in claim 13, together with:

a hinged door closure for said lateral opening mounted on said wall means; and, a lockable latch for securing said door in the closed position.

* * * * *